US008413831B2

(12) United States Patent
Nolan

(10) Patent No.: US 8,413,831 B2
(45) Date of Patent: Apr. 9, 2013

(54) COLLAPSIBLE BIN

(75) Inventor: Roger Nolan, Seymour, IN (US)

(73) Assignee: Orbis Corporation, Oconomowoc, WI (US)

( * ) Notice: Subject to any disclaimer, the term of this patent is extended or adjusted under 35 U.S.C. 154(b) by 224 days.

(21) Appl. No.: 12/963,791

(22) Filed: Dec. 9, 2010

(65) Prior Publication Data

US 2011/0139774 A1 Jun. 16, 2011

(30) Foreign Application Priority Data

| | | |
|---|---|---|
| Dec. 16, 2009 | (CN) | 2009 3 0355382 |
| Dec. 16, 2009 | (CN) | 2009 3 0355383 |
| Dec. 16, 2009 | (CN) | 2009 3 0355384 |
| Feb. 10, 2010 | (CN) | 2010 2 0111642 |
| Mar. 16, 2010 | (CN) | 2010 2 0132357 |
| Mar. 30, 2010 | (CN) | 2010 2 0145498 |
| Apr. 14, 2010 | (CN) | 2010 2 0159206 |
| Apr. 23, 2010 | (CN) | 2010 2 0169698 |
| May 19, 2010 | (CN) | 2010 2 0198781 |
| Jun. 4, 2010 | (CN) | 2010 2 0218082 |
| Jun. 4, 2010 | (CN) | 2010 2 0218085 |

(51) Int. Cl.

| | |
|---|---|
| ***B65D 6/18*** | (2006.01) |
| ***B65D 6/16*** | (2006.01) |
| ***B65D 90/08*** | (2006.01) |
| ***B65D 19/18*** | (2006.01) |

(52) U.S. Cl. ..... 220/7; 220/6; 220/4.28; 220/691; 220/677; 220/666; 220/615; 220/682; 217/12 R; 217/15; 217/47; 206/600

(58) Field of Classification Search ..... 220/6, 666, 220/615, 682, 7, 4.28, 4.33, 691, 977; 217/12 R, 217/15, 47; 206/600
See application file for complete search history.

(56) References Cited

U.S. PATENT DOCUMENTS

| | | | | |
|---|---|---|---|---|
| 3,572,535 A | | 3/1971 | Kinzie | |
| 3,874,546 A | | 4/1975 | Sanders et al. | |
| 4,044,910 A | * | 8/1977 | Box | 220/7 |
| 4,192,430 A | | 3/1980 | Cornou | |
| 4,300,695 A | | 11/1981 | Hsu | |
| 4,454,946 A | | 6/1984 | Yokowo | |
| 4,491,231 A | * | 1/1985 | Heggeland et al. | 220/6 |
| 4,591,065 A | | 5/1986 | Foy | |

(Continued)

FOREIGN PATENT DOCUMENTS

| | | |
|---|---|---|
| EP | 0385914 A1 | 5/1990 |
| EP | 0768229 B1 | 7/1999 |

(Continued)

*Primary Examiner* — Anthony Stashick
*Assistant Examiner* — Jennifer Castriotta
(74) *Attorney, Agent, or Firm* — Ungaretti & Harris LLP

(57) ABSTRACT

A collapsible bin is provided. The bin includes a pair of opposing side panels. The bin further includes a pair of opposing end panels. At least one of the end panels has a first plurality of male interlocking members extending outward a first distance along an upper portion of a first side edge, and a second plurality of male interlocking members extending outward a second distance greater than the first distance along a lower portion of its first side edge. At least one of the side panels includes a plurality of female interlocking members along a first side edge for receiving the first and second pluralities of male interlocking members extending along the first side edge of the at least one side panel.

19 Claims, 13 Drawing Sheets

U.S. PATENT DOCUMENTS

| | | | | |
|---|---|---|---|---|
| 4,674,647 | A | 6/1987 | Gyenge et al. | |
| 4,765,480 | A | 8/1988 | Malmanger | |
| 4,775,068 | A | 10/1988 | Reiland et al. | |
| 4,917,255 | A | 4/1990 | Foy et al. | |
| 4,923,079 | A | 5/1990 | Foy | |
| 4,967,927 | A | 11/1990 | Reiland et al. | |
| 4,987,639 | A | 1/1991 | Baiuley et al. | |
| 5,094,356 | A | 3/1992 | Miller | |
| 5,114,037 | A | 5/1992 | Hillis et al. | |
| 5,199,592 | A | 4/1993 | Reiland et al. | |
| 5,289,935 | A | 3/1994 | Hillis et al. | |
| 5,467,885 | A | 11/1995 | Blinstrub | |
| 5,474,197 | A | 12/1995 | Hillis et al. | |
| 5,538,178 | A | 7/1996 | Zink et al. | |
| 5,660,291 | A | 8/1997 | Dash | |
| 5,711,444 | A | 1/1998 | Meacham et al. | |
| 5,725,119 | A | 3/1998 | Bradford et al. | |
| 5,788,103 | A | 8/1998 | Wagner et al. | |
| 5,797,508 | A | 8/1998 | Loftus et al. | |
| 5,845,799 | A | 12/1998 | Deaton | |
| 5,850,935 | A | 12/1998 | Luburic et al. | |
| 5,897,012 | A | 4/1999 | Sortwell | |
| 5,908,135 | A | 6/1999 | Bradford et al. | |
| 5,938,059 | A | 8/1999 | Luburic | |
| 6,015,056 | A * | 1/2000 | Overholt et al. | 220/6 |
| 6,029,839 | A | 2/2000 | Mansouri | |
| 6,062,410 | A | 5/2000 | Bradford et al. | |
| 6,135,287 | A | 10/2000 | Hartwall | |
| 6,186,932 | B1 | 2/2001 | Vallot | |
| 6,189,695 | B1 | 2/2001 | Ching-rong | |
| 6,223,903 | B1 | 5/2001 | Mansouri | |
| 6,230,916 | B1 | 5/2001 | Bradford et al. | |
| 6,283,319 | B1 | 9/2001 | Hillis et al. | |
| 6,293,417 | B1 | 9/2001 | Varfeldt | |
| 6,293,418 | B1 * | 9/2001 | Ogden et al. | 220/7 |
| 6,305,726 | B1 | 10/2001 | LeTrudet | |
| 6,416,271 | B1 | 7/2002 | Pigott et al. | |
| 6,422,409 | B2 | 7/2002 | Kofod | |
| 6,484,898 | B2 | 11/2002 | Hillis et al. | |
| RE37,915 | E | 12/2002 | Lapoint, III | |
| 6,540,096 | B1 | 4/2003 | Bazany et al. | |
| 6,543,659 | B2 | 4/2003 | Blair | |
| 6,691,885 | B2 | 2/2004 | Brown | |
| 6,726,046 | B2 | 4/2004 | Orset | |
| 6,776,300 | B2 | 8/2004 | Walsh et al. | |
| 6,783,032 | B2 | 8/2004 | Fons | |
| 6,783,058 | B2 | 8/2004 | Quaintance | |
| 6,786,394 | B2 | 9/2004 | Prince | |
| 6,805,254 | B2 | 10/2004 | Tanzer et al. | |
| 6,877,628 | B2 | 4/2005 | Nesting | |
| 6,902,061 | B1 | 6/2005 | Elstone | |
| 6,955,273 | B2 | 10/2005 | Hartwall | |
| 7,011,225 | B2 | 3/2006 | Oster et al. | |
| 7,032,765 | B2 | 4/2006 | Miller et al. | |
| 7,083,369 | B2 | 8/2006 | Nyeboer | |
| 7,137,522 | B2 | 11/2006 | Dubois | |
| 7,195,127 | B2 | 3/2007 | Hsu et al. | |
| 7,258,232 | B2 | 8/2007 | Bradford et al. | |
| 7,287,661 | B2 | 10/2007 | Knutsson et al. | |
| 7,311,220 | B2 | 12/2007 | Kellerer | |
| 7,347,328 | B2 | 3/2008 | Hartwall | |
| 7,416,092 | B2 | 8/2008 | Dubois et al. | |
| 7,484,634 | B2 | 2/2009 | Apps | |
| 7,540,390 | B2 | 6/2009 | Bublitz et al. | |
| 7,774,919 | B2 | 8/2010 | Bublitz et al. | |
| 7,861,458 | B2 | 1/2011 | Apps et al. | |
| 2002/0108950 | A1 * | 8/2002 | Moorman et al. | 220/7 |
| 2004/0182858 | A1 | 9/2004 | Smyers | |
| 2004/0200833 | A1 | 10/2004 | Dubois | |
| 2006/0249416 | A1 | 11/2006 | Bradford | |
| 2007/0029319 | A1 | 2/2007 | Speck | |
| 2007/0056967 | A1 | 3/2007 | Dobrinski et al. | |
| 2007/0056977 | A1 | 3/2007 | Dobrinski et al. | |
| 2007/0068941 | A1 | 3/2007 | Dubois | |
| 2007/0075077 | A1 | 4/2007 | Dubois | |
| 2008/0017638 | A1 | 1/2008 | Bradford | |
| 2008/0116199 | A1 | 5/2008 | Bublitz et al. | |
| 2008/0169285 | A1 | 7/2008 | Marazita et al. | |
| 2008/0203089 | A1 | 8/2008 | Hartwall | |
| 2009/0044376 | A1 | 2/2009 | Nolan | |
| 2009/0152265 | A1 | 6/2009 | Nolan | |
| 2009/0266813 | A1 | 10/2009 | Afflerbach et al. | |
| 2010/0038331 | A1 | 2/2010 | Ydstrom | |
| 2010/0072199 | A1 | 3/2010 | Manuel | |
| 2010/0275426 | A1 | 11/2010 | Bublitz et al. | |

FOREIGN PATENT DOCUMENTS

| | | | |
|---|---|---|---|
| EP | 1019293 | B1 | 5/2002 |
| EP | 0737152 | B1 | 8/2002 |
| EP | 1350728 | A2 | 10/2003 |
| EP | 1427641 | B1 | 6/2004 |
| EP | 1461259 | B1 | 9/2004 |
| EP | 1440011 | B1 | 6/2006 |
| EP | 1827942 | A2 | 9/2007 |
| EP | 1927552 | A2 | 6/2008 |
| EP | 1616803 | B1 | 10/2009 |
| GB | 2426237 | B | 12/2008 |
| WO | 0176960 | A1 | 10/2001 |
| WO | 03024815 | A1 | 3/2003 |
| WO | 03029090 | A1 | 4/2003 |
| WO | 03074376 | A1 | 9/2003 |
| WO | 2005102852 | A1 | 11/2005 |
| WO | 2006044488 | A2 | 4/2006 |
| WO | 2006062894 | A2 | 6/2006 |
| WO | 2007035464 | A2 | 3/2007 |
| WO | 2007109468 | A2 | 9/2007 |
| WO | 2008033668 | A2 | 3/2008 |

* cited by examiner

COLLAPSIBLE BIN

CROSS-REFERENCE TO RELATED APPLICATIONS

The present application claims the benefit of Chinese Patent Application No.200930355384.9, entitled Nine Feet Geometric Bulk Plastic Container—No Door, filed Dec. 16, 2009; Chinese Patent Application No. 200930355383.4, entitled, Stringer Geometric Bulk Plastic Container, filed Dec. 16, 2009; Chinese Patent Application No. 200930355382.X, entitled Nine Feet Geometric Bulk Plastic Container, filed Dec. 16, 2009; Chinese Patent Application No. 201020111642.6, entitled Bulk Plastic Container Panel By Geometric Structure, filed Feb. 10, 2010; Chinese Patent Application No. 201020132357.2, entitled Universal Latch for Bulk Plastic Container, filed Mar. 16, 2010; Chinese Patent Application No. 201020145498.8, entitled Floating Hinge Lock Structure, filed Mar. 30, 2010; Chinese Patent Application No. 201020159206.6, entitled Erected Side Wall Lock Structure, filed Apr. 14, 2010; Chinese Patent Application No. 201020169698.7, entitled 45 Degree Assembly Structure for Side Wall, filed Apr. 23, 2010; Chinese Patent Application No. 201020198781.7, entitled Notch Structure for Low Profile Container, filed May 19, 2010; Chinese Patent Application No. 201020218085.8, entitled Lock Structure for Connecting Panel-Long Ribs and Short Ribs, filed Jun. 4, 2010; Chinese Patent Application No. 201020218082.4, entitled Double Rib Structure on Panels, filed Jun. 4, 2010, the contents of all of which are incorporated herein by reference.

The present application also claims the benefit of co-pending U.S. Patent Applications entitled "Fork Tine Notch," Ser. No. 12/963,769, and "Bulk Container with Angled Side Wall to Base Installation," Ser. No. 12/963,751, both concurrently filed herewith, the contents of which are incorporated herein by reference.

FEDERALLY SPONSORED RESEARCH OR DEVELOPMENT

Not applicable.

FIELD OF THE INVENTION

The present invention generally relates to a collapsible bin for transporting and/or storing items or materials.

BACKGROUND OF THE INVENTION

Many different types of containers are used for transporting and displaying goods. Plastic collapsible bins with foldable side panels are in common use. An example of a collapsible bin is shown in U.S. Pat. No. 4,674,647 to Gyenge et al.

Plastic collapsible bins can vary in size to accommodate the intended items or materials with which they will be used. Larger bins can be handled by standard forklifts to facilitate transport and storage. The bins are typically made of a base with hinged side and end panels. The base and the side and end panels are made of an injection molded plastic. The panels include hinges, often integrally formed, at their bottom edges. The hinges cooperate with the base to allow the end and side panels to be folded downward over the base when the bin is not in use. To erect the side and end panels, the panels are typically extended upward from their folded position and interlocked at their edges. To accommodate the interlocking, the edges of the side and end panels include mating or interlocking members. The side and end panels are latched to each other when in the fully erected position for stability.

A commonly occurring problem with collapsible bins in current use results from the base warping over time such that the sides of the base tend to bow outward. The outward bowing of the base prevents the mating members at the edges of the panels from properly aligning and interlocking. This can occur, for example, when bins are stacked upon each other, thereby causing outward pressure due to weight on the side panels. Another potential cause of outward bowing is improper latching of the panels, which causes the panels to lean outward when placed under load. Repeated loading and use in hot temperatures further contributes to the outward bowing.

The present invention provides a collapsible bin with an improved side and end panel interlocking mechanism to overcome the effect of outward bowing of its base and panels.

SUMMARY OF THE INVENTION

In accord with an embodiment of the present invention, a collapsible bin is provided. The bin includes a base having an upper surface, a pair of opposing ends, and a pair of opposing sides. The bin also includes a pair of opposing side panels. Each side panel is attachable to a respective base side. Each side panel includes an inner face, an outer face, and first and second side edges. The first and second side edges have an upper portion and a lower portion. The bin further includes a pair of opposing end panels. Each end panel is attachable to a respective base end. Each end panel includes an inner face, an outer face, and first and second side edges. The first and second side edges have an upper portion and a lower portion. At least one of the end panels has a first plurality of male interlocking members extending outward a first distance along the upper portion of its first side edge, and a second plurality of male interlocking members extending outward a second distance greater than the first distance along the lower portion of its first side edge. At least one of the side panels includes a plurality of female interlocking members along its first side edge for receiving the first and second pluralities of male interlocking members extending along the first side edge of the at least one side panel In accord with another embodiment of the invention, the end panels of the collapsible bin are capable of movement between an assembled position generally perpendicular to the base and a folded position over the upper surface of the base. At least one of the end panels includes a first plurality of interlocking members along its first side edge. At least one of the side panels has a second plurality of interlocking members along its first side edge for engaging the first plurality of interlocking members. The interlocking members in the lower portions of the side and end panels engage as the side and end panels are moved to the assembled position as to create a zippering effect to facilitate alignment of the interlocking members.

In accord with a further embodiment of the invention, at least one of the end or side panels includes a first plurality of male interlocking members extending along its first side edge. The first plurality has a lowermost member and an uppermost member. Each member extends outward a distance from the first side edge. The distances generally decrease in a direction from the lowermost member to the uppermost member. At least one of the side panels includes a second plurality of female interlocking members along its first side edge for receiving the first plurality of male interlocking members extending along the first side edge of the at least one side panel.

Other features and advantages of the invention will be apparent from the following specification taken in conjunction with the following Figures.

BRIEF DESCRIPTION OF THE FIGURES

To understand the present invention, it will now be described by way of example, with reference to the accompanying Figures in which.

DETAILED DESCRIPTION OF THE INVENTION

While this invention is susceptible of embodiments in many different forms, there is shown in the Figures and will herein be described in detail preferred embodiments of the invention with the understanding that the present disclosure is to be considered as an exemplification of the principles of the invention and is not intended to limit the broad aspect of the invention to the embodiments illustrated.

Figure 1:
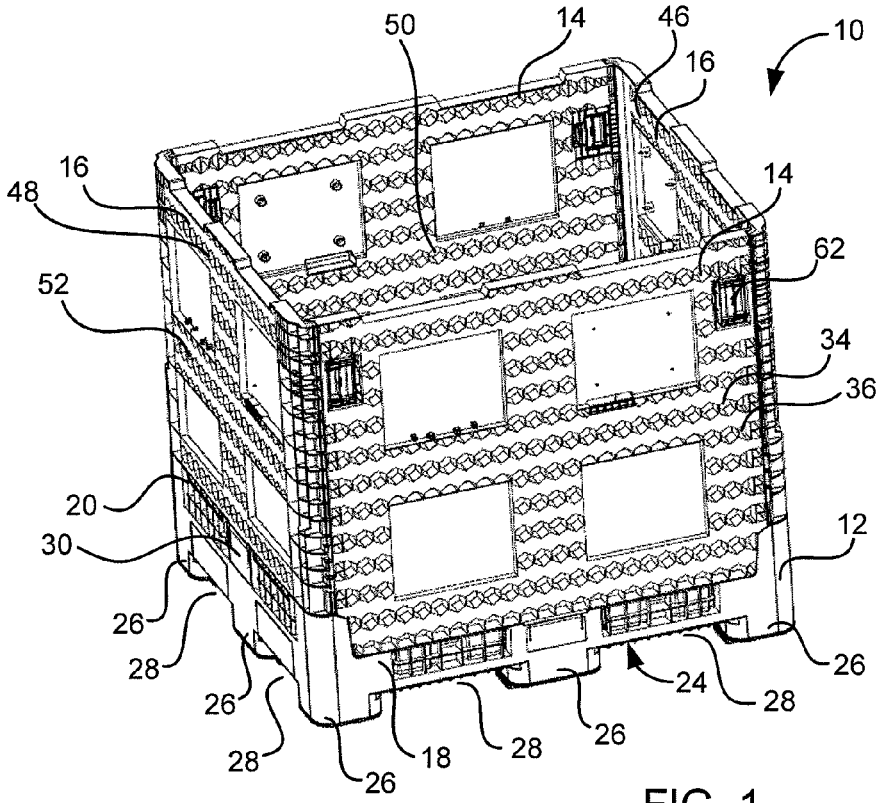
FIG. 1 is a perspective view of a collapsible bin in an erected condition in accord with an embodiment of the present invention.

Referring to FIG. 1, a collapsible bin 10 includes a base 12, a pair of opposing end panels 14, and a pair of opposing side panels 16. The base 12, the end panels 14, and side panels 16 are preferably made using a plastic molding process.

The base 12 has a pair of opposing ends 18 and a pair of opposing sides 20. The base 12 also includes an upper surface (not shown), also known as the deck, and a lower surface 24. Items or materials to be transported or stored are placed on the upper surface. Legs 26 extend from the lower surface 24 to support the base 12. The legs 26 define fork tunnels 28 for forklift tine access to permit the bin 10 to be moved using a forklift. The upper surface is typically a flat sheet of plastic. The lower surface 24 of the base 12 can include ribs (not shown) to provide structure and to strengthen the base 12.

Figure 2:
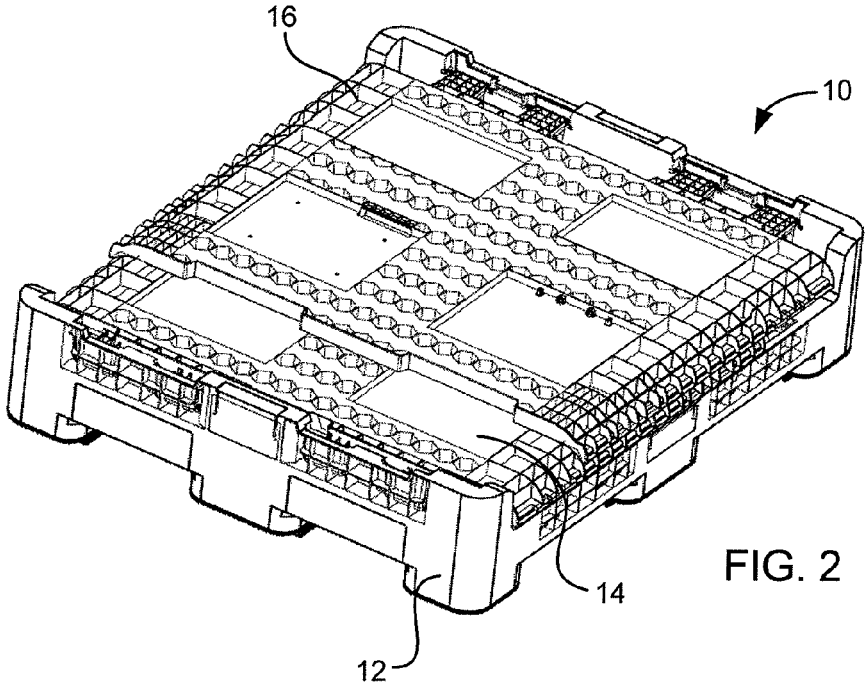
FIG. 2 is a perspective view of a collapsible bin in a collapsed condition in accord with an embodiment of the present invention.
Figure 4:
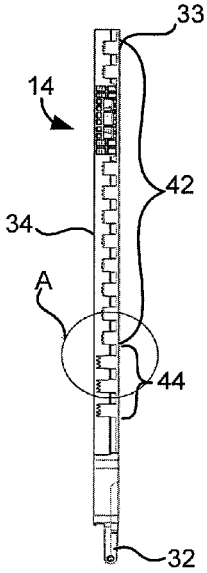
FIG. 4 is a side view of the end panel of FIG. 3.
Figure 3:
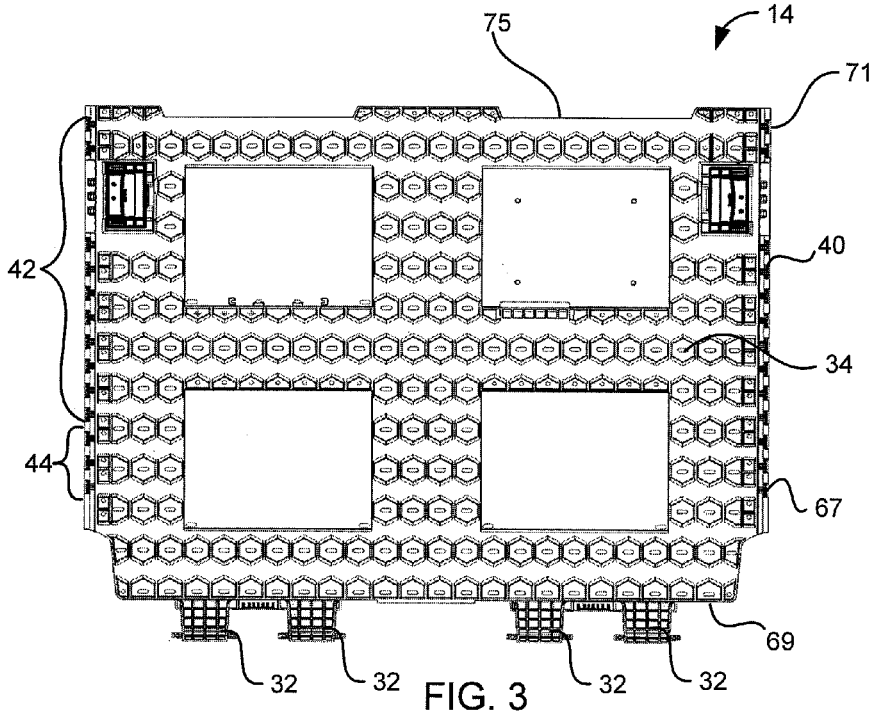
FIG. 3 is a plan view of an end panel of a collapsible bin in accord with an embodiment of the present invention.
Figure 5:
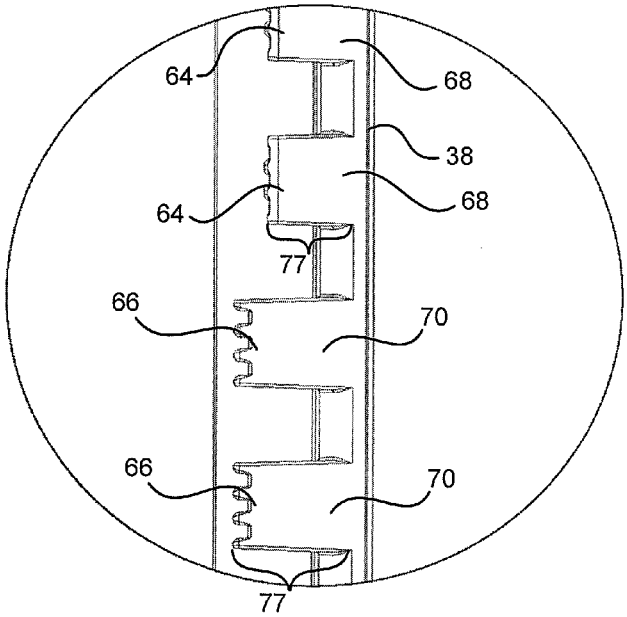
FIG. 5 is an enlarged view of Section A of FIG. 4.
Figure 6:
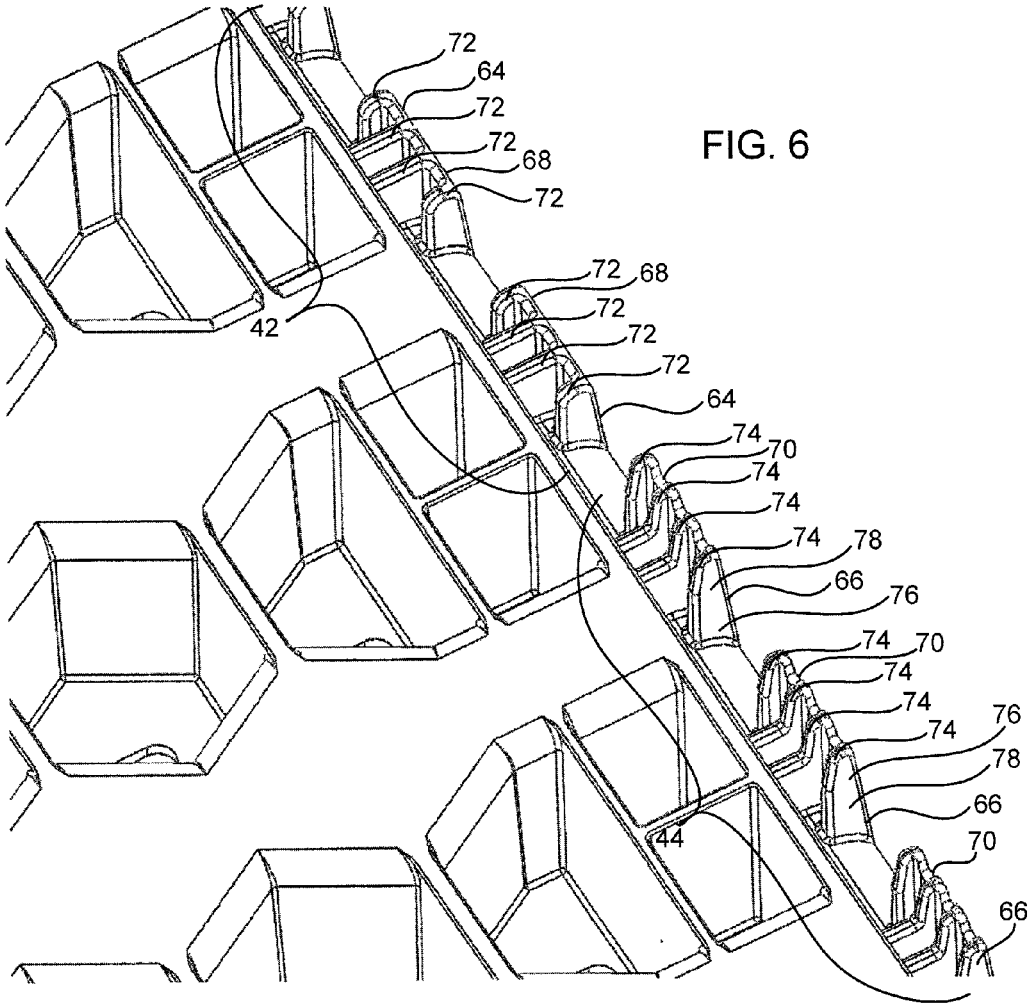
FIG. 6 is an enlarged perspective view of a portion of the end panel of FIG. 3.

As best shown in FIGS. 1 through 6, the base 12 includes at its opposing sides 20 raised edges 30 extending upwardly from the base 12. FIG. 1 shows the bin 10 in an erected position. FIG. 2 shows the bin 10 in a collapsed position. In accord with an embodiment of the present invention, the end panels 14 and side panels 16 are attached to the base 12 via hinges 32 at the base ends 18 and sides 20, respectively. The raised edges 30 along the sides 20 permit the end panels 14 and side panels 16 to be folded over the base 12 as shown in FIG. 2.

Either the end panels 14 or side panels 16 can have doors (not shown) for access to items or materials stored within the bin 10 when the bins 10 are stacked upon each other. The doors have hinges at a bottom edge to permit them to swing downwardly about the hinges. The doors also include latches to selectively open and secure the doors in a closed position.

Each of the opposing end panels 14 includes an inner face 33 and an outer face 34. The inner face 33 faces an interior area 50 defined by the end panels 14 and side panels 16 when in a fully assembled erect position. The inner face 33 may be a flat planar surface, while the outer face 34 may have ribs 36 for support and strength. The end panels 14 each also include a first side edge 38 and a second side edge 40. The end panels 14 each also have an upper portion 42 and a lower portion 44. (See e.g., FIGS. 3 and 4).

Each of the opposing side panels 16 includes an inner face 46 and an outer face 48. The inner face 46 faces the interior area 50. The inner face 46 can be a flat planar surface, while the outer face 48 may have ribs 52 for support and strength. The side panels 16 each include a first side edge 54 and a second side edge 56. The side panels 16 also have an upper portion 58 and a lower portion 60. Hinges 61 attach the side panels 16 to the base 12. Either the end panels 14 or side panels 16 can have a latching mechanism 62 to secure the side and end panels 16 and 14 together when the bin 10 is in the erected position of FIG. 1.

In accord with an embodiment of the present invention, each of the opposing end panels 14 includes a first plurality of male interlocking members 64 in its upper portion 42 and a second plurality of male interlocking members 66 in its lower portion 44 spaced along its first and second side edges 38 and 40. The first plurality of male interlocking members 64 includes a lowermost member 67. The lowermost member 67 is located nearest a lower edge 69 of the end panel 14. The second plurality of male interlocking members 66 includes an uppermost member 71. The uppermost member 71 is located nearest an upper edge 75 of the end panel 14

The first and second pluralities of male interlocking members 64 and 66 extend a distance 77 from the first and second side edges 38 and 40 of the end panel 14. The first and second pluralities of male interlocking members 64 and 66 include outer walls 68 and 70, and a plurality of inwardly extending ribs 72 and 74, respectively. The ribs 72 and 74 extend generally perpendicular to the outer face 34. The outer walls 70 of the second plurality of male interlocking members 66 in the lower portion 44 extend a greater distance outward from the first side edge 38 of the end panel 14 than the outer walls 68 of the first plurality of male interlocking members 64 in the upper portion 42. The ribs 74 of the second plurality of male interlocking members 66 in the lower portion 44 each have a raised portion 76 nearest the outer wall 70 forming fingers 78.

In accord with an embodiment of the invention, the raised portions 76 and fingers 78 are coextensive with the increased height of the outer walls 68.

In accord with an embodiment of the invention, the male interlocking members 64 and 66 can include additional third or fourth or more pluralities of male interlocking members. It is contemplated that the distance 77 the male interlocking members extend from the first side edge 38 will be greatest nearest the lower edge 69 of the end panel 14, and will generally decrease in a direction towards the upper edge 75. In such embodiments, the male interlocking members of the pluralities 64 and 66 can each individually extend different distances 77 from the first side edge 38 of the end panel 14 such that in a direction from lowermost 67 to uppermost member 71, the decreases in distances 77 are constant, or vary to result in a generally downward slope.

Figure 7:
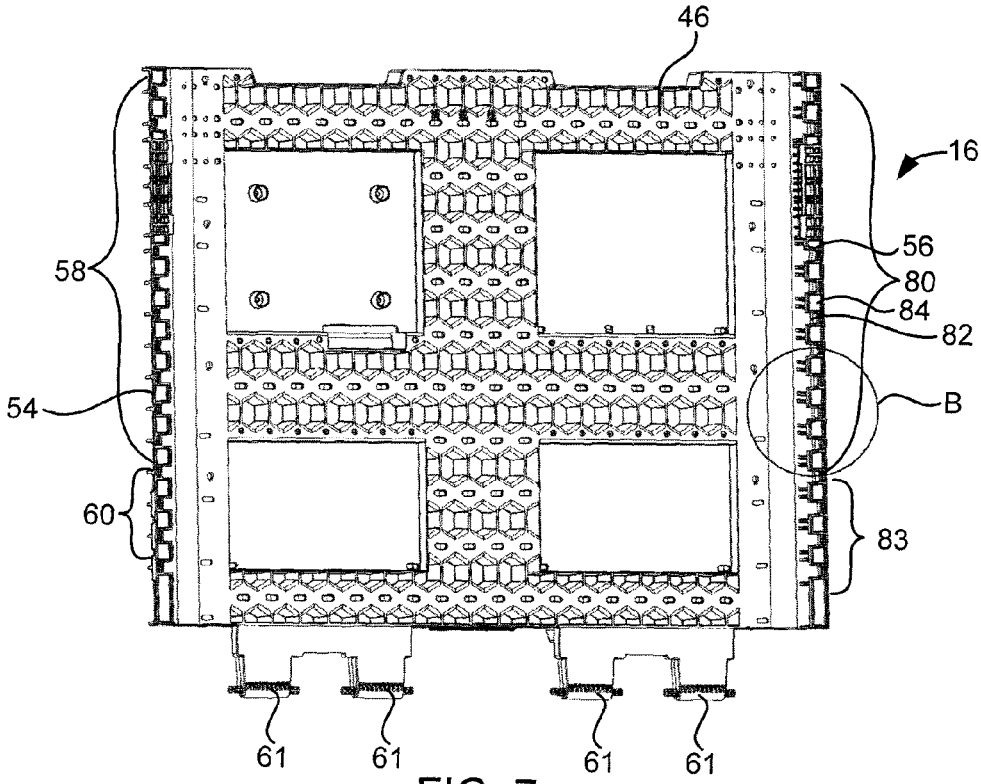
FIG. 7 is a plan view of a side panel of a collapsible bin in accord with an embodiment of the present invention.
Figure 8:
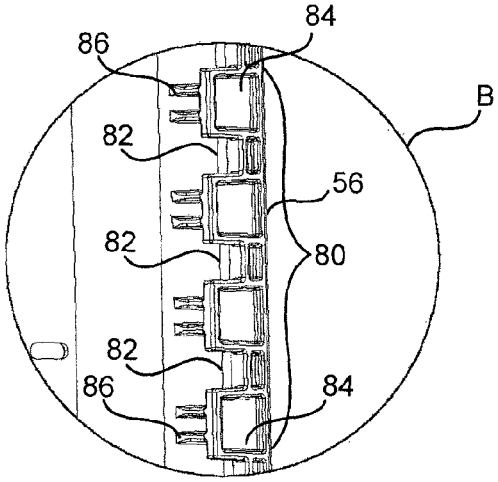
FIG. 8 is an enlarged view of Section B of FIG. 7.
Figure 9:
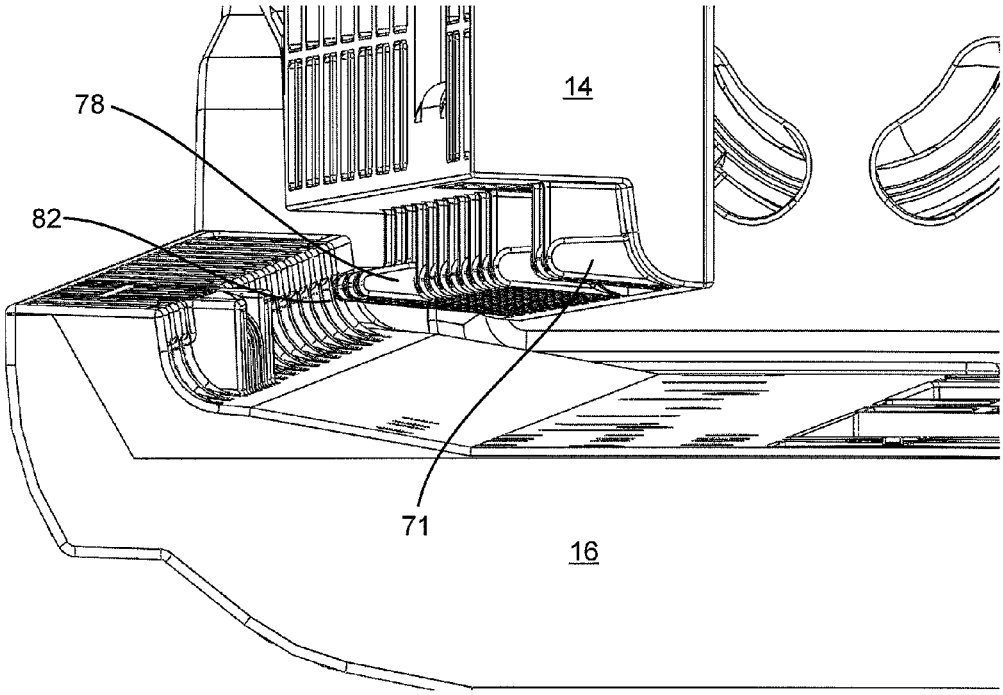
FIG. 9 is a top perspective view of the interlocking of end and side panels in accord with an embodiment of the present invention.
Figure 10:
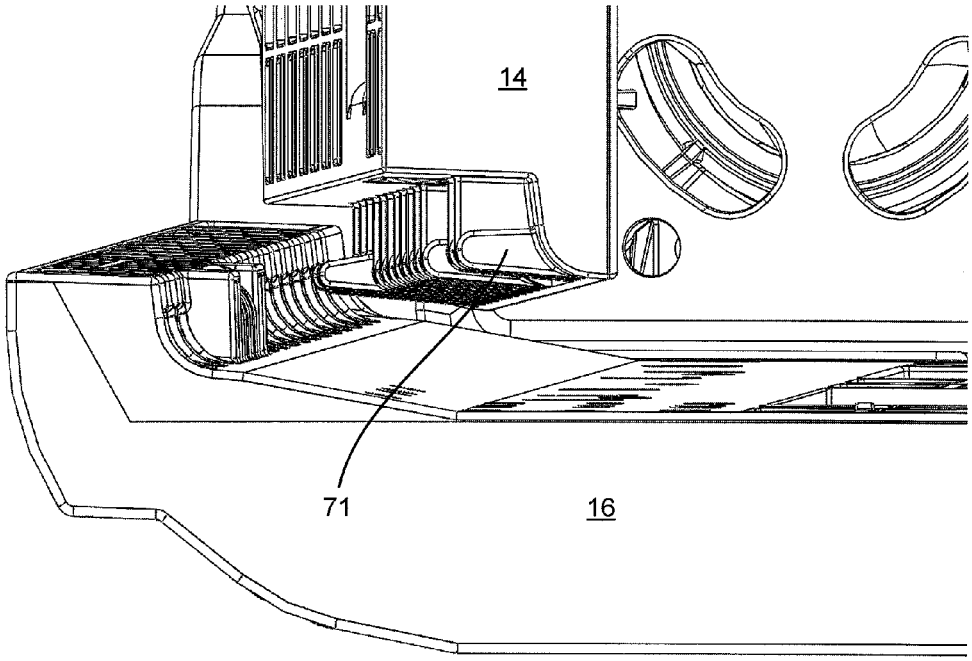
FIG. 10 is a top perspective view of the interlocking of end and side panels in accord with an embodiment of the present invention.
Figure 11:
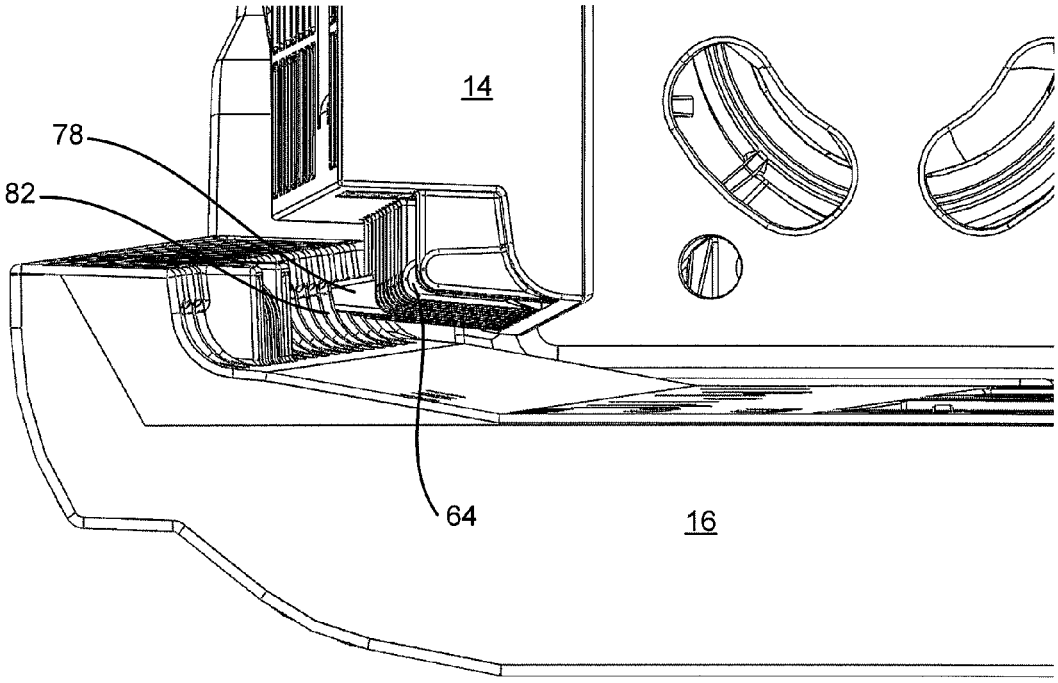
FIG. 11 is a top perspective view of the interlocking of end and side panels in accord with an embodiment of the present invention.
Figure 12:
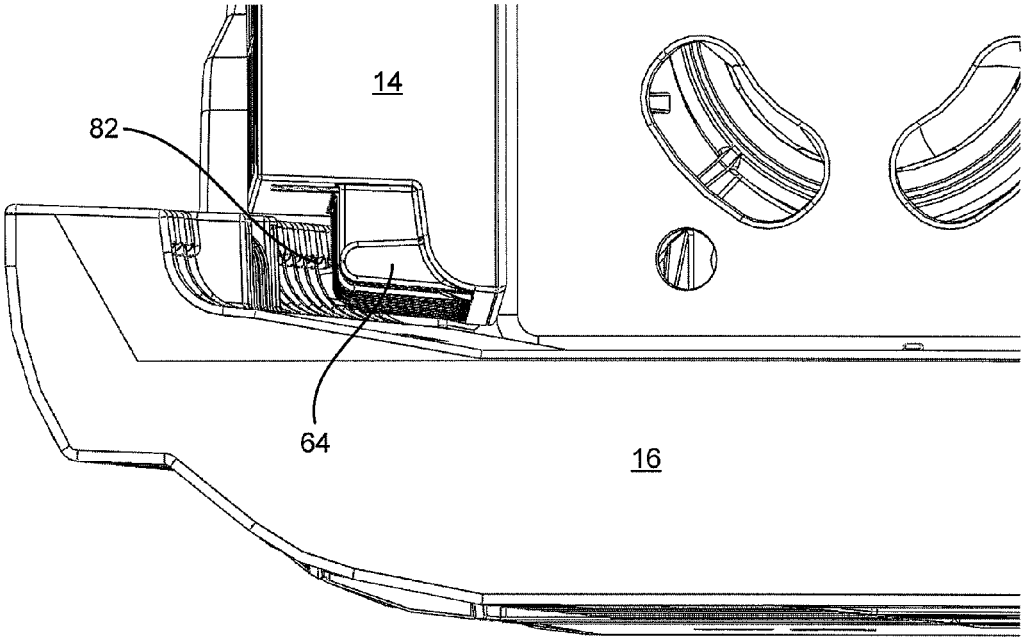
FIG. 12 is a top perspective view of the interlocking of end and side panels in accord with an embodiment of the present invention.
Figure 13:
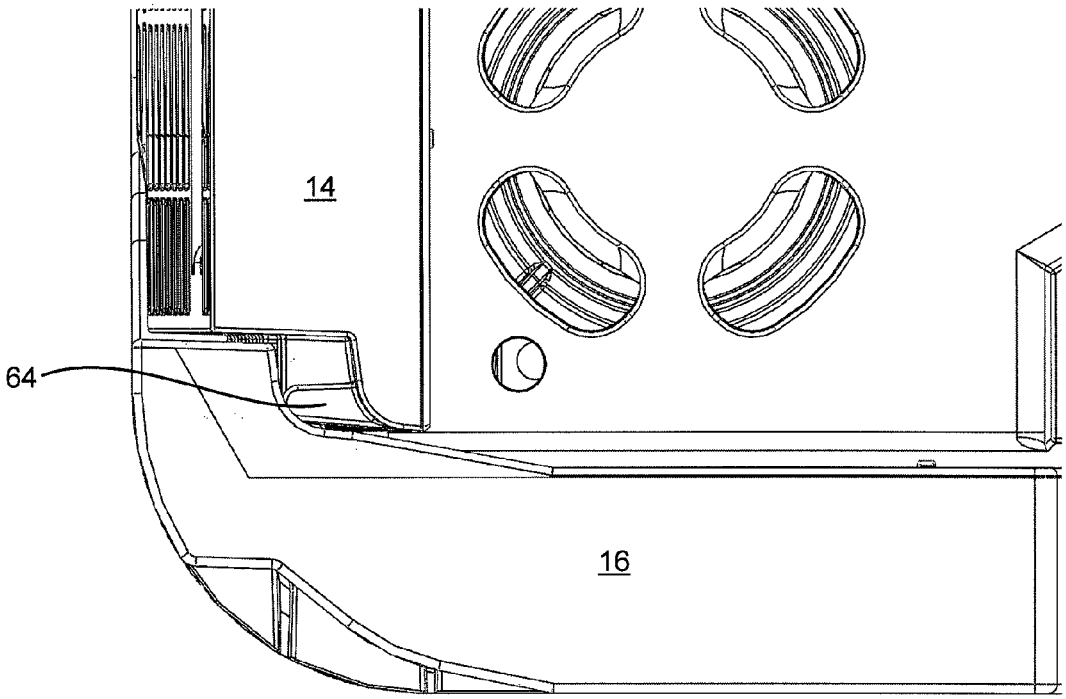
FIG. 13 is a top perspective view of the interlocking of end and side panels in accord with an embodiment of the present invention.
Figure 14:
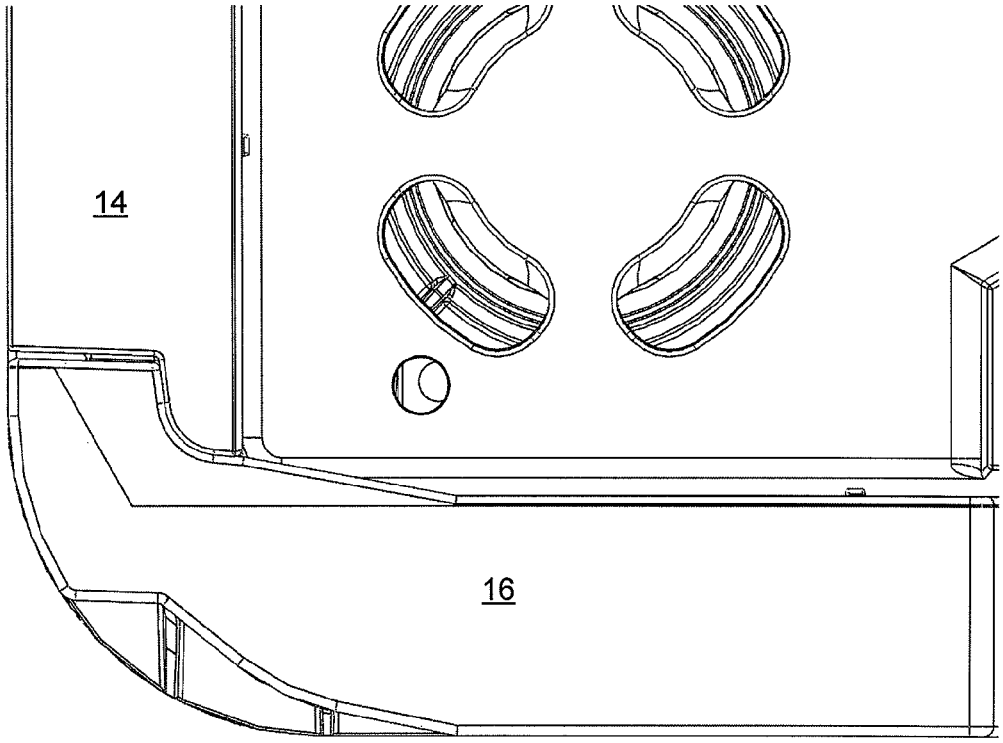
FIG. 14 is a top perspective view of interlocked end and side panels in accord with an embodiment of the present invention.

As shown in FIGS. 7 and 8, each of the opposing side panels 16 includes along its first side edge 54 a first plurality of female interlocking members 80, and second plurality of female interlocking members 83 that engage the first and second pluralities of male interlocking members 64 and 66, respectively. The female interlocking members 80 and 83 include interstices 82 between generally rectangular tabs 84 integral with the first side edge 54. The tabs 84 are supported by ribs 86. The second plurality of female interlocking members 83 in the lower portion 60 of the side panel 16 are sized and spaced to engage the greater height of the second plurality of male interlocking members 66 in the lower portion 44 of the end panel 14. The female interlocking members 83 are spaced to accept and engage the male interlocking members 66.

As shown in FIGS. 9 through 14, to assemble the bin 10 from its folded position the end panels 14 and side panels 16 are rotated about their hinges 32 and 61 such that they are generally perpendicular, or slightly out of perpendicular, to the upper surface 22 of the base 12. As the end panels 14 and side panels 16 are raised, the first and second pluralities of male interlocking members 64 and 66 and female interlocking members 80 and 83 are brought into proximity. As an end panel 14 is brought to its fully vertical position, the second plurality of male interlocking members 66 in the lower portion 44 of the end panel 14 begin to engage the interstices 82 of the second plurality of female interlocking members 83 in the lower portion 60 of the side panel 16. Because the second plurality of male interlocking members 66 in the lower portion 44 are of a greater height than those of the upper portion 42, they will engage their corresponding female members 83 to create a zippering effect as the end panel 14 and side panel 16 continue to be raised to their fully upright positions. This zippering effect aligns and draws the upper portions 42 and 58 of the end and side panels 14 and 16 together for proper alignment to facilitate latching using latches 62.

Figure 15:
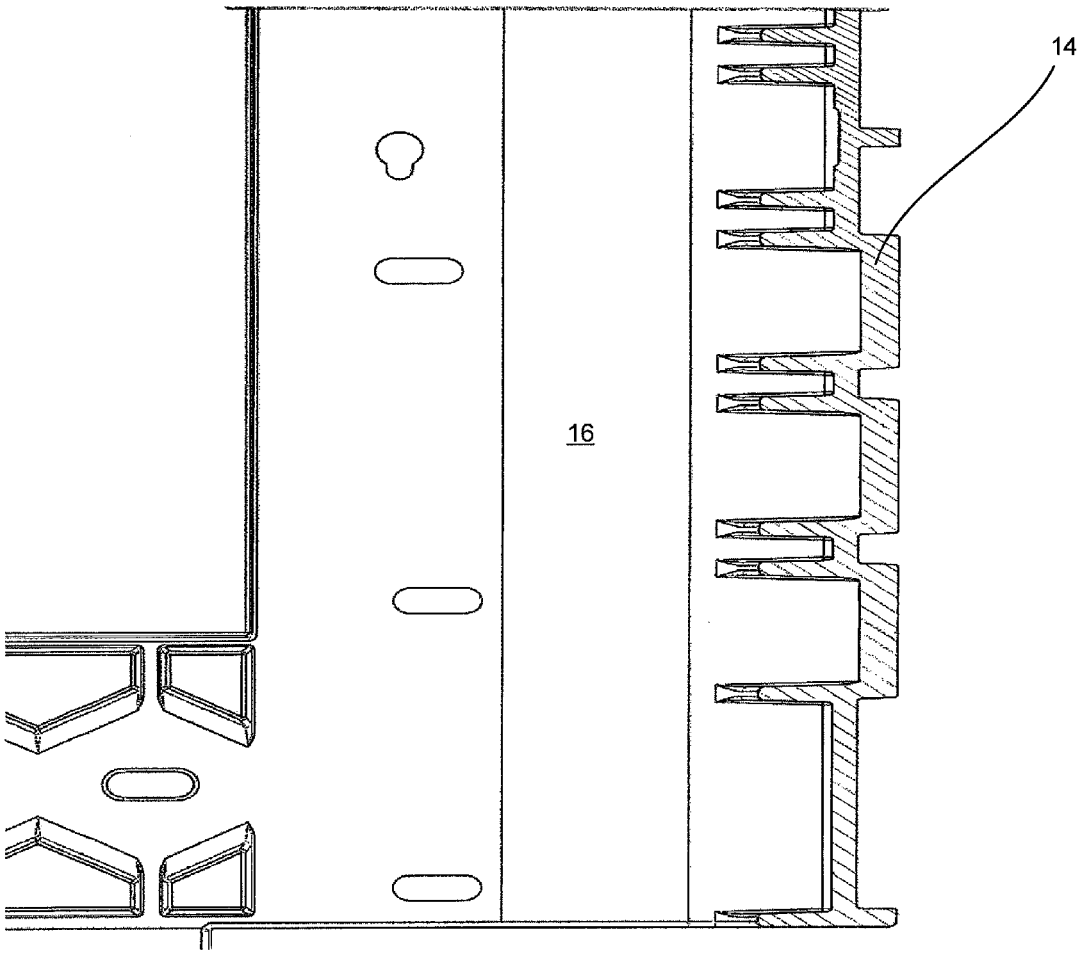
FIG. 15 is a side sectional view of a side panel in accord with an embodiment of the present invention.
Figure 16:
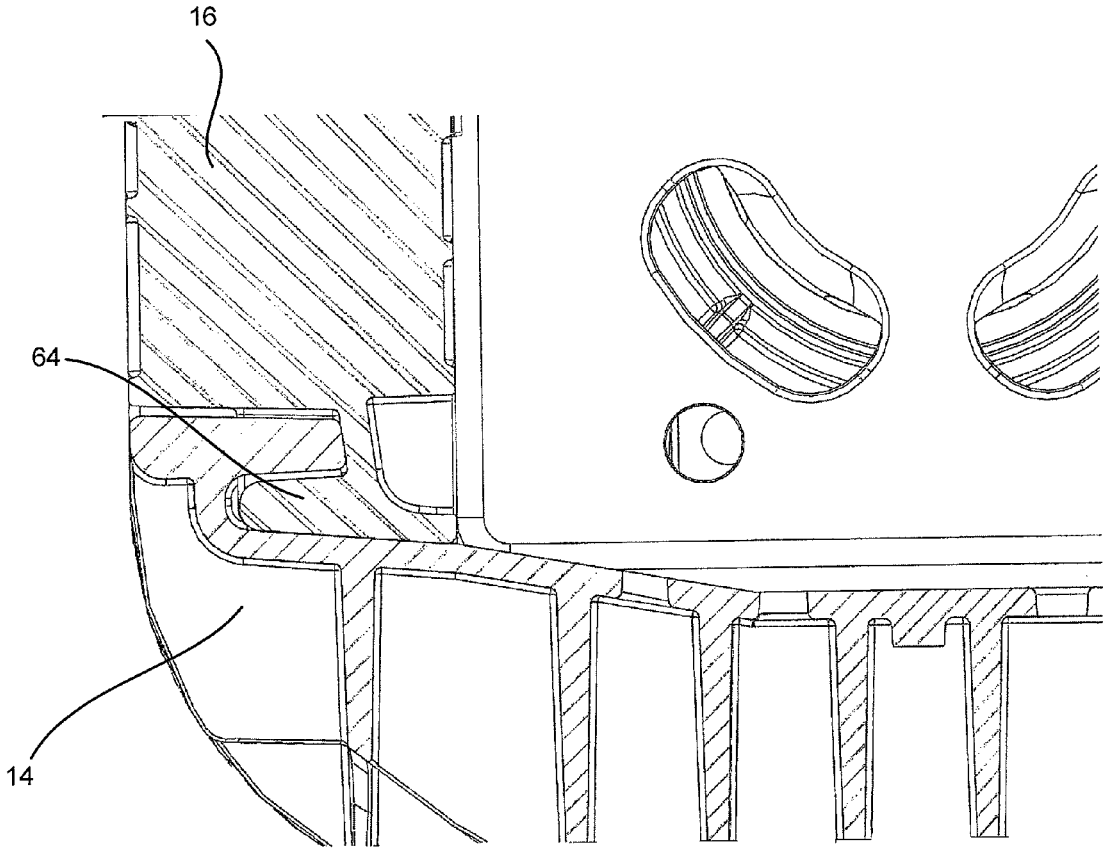
FIG. 16 is a top sectional view of interlocked end and side panels in accord with an embodiment of the present invention.
Figure 17:
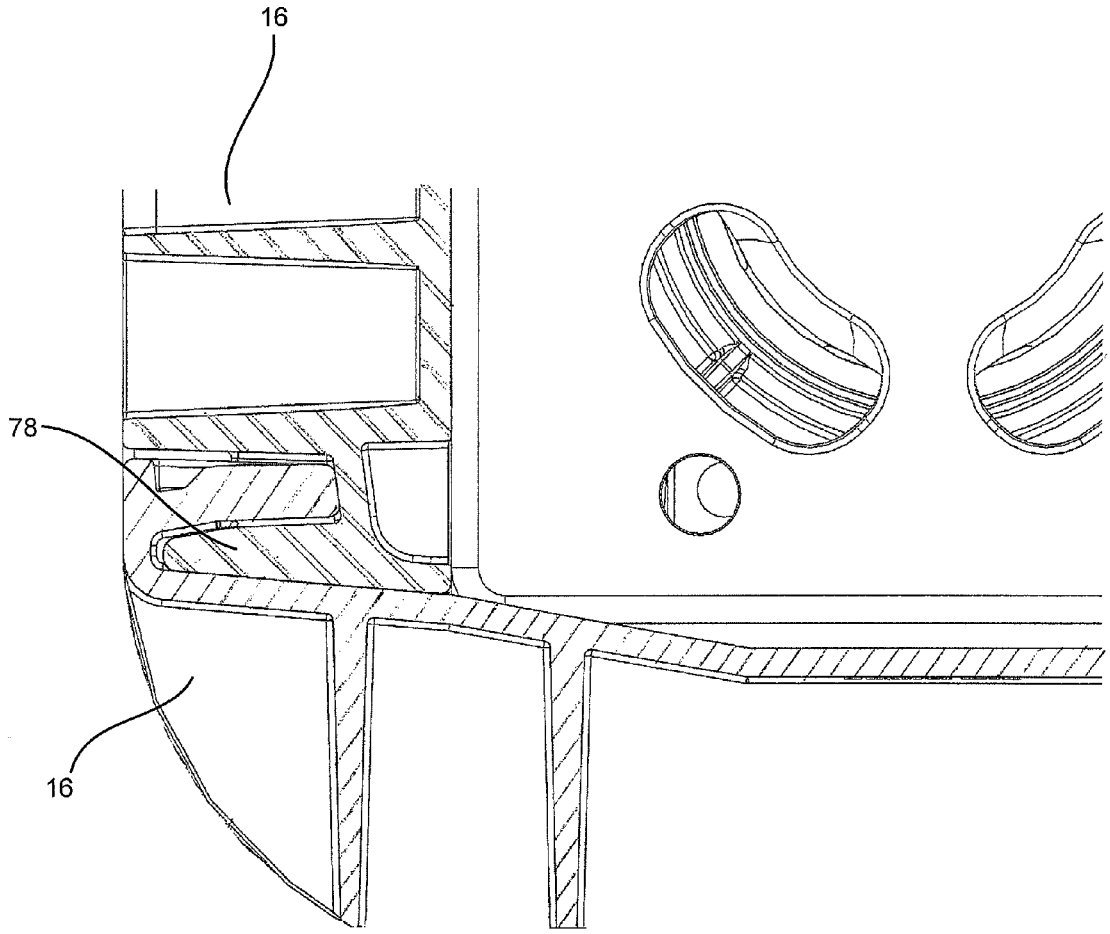
FIG. 17 is a top sectional view of interlocked end and side panels in accord with an embodiment of the present invention.

FIGS. 15 to 17 show sectional views of the end and side panels 14 and 16 in the fully erected position. FIGS. 17 shows a top sectional view of the second plurality of male interlocking members 66 engaged with the corresponding interstices 82 of the second plurality of female interlocking members 83. As shown in FIG. 17, the interstices 82 in the lower portion 60 of the side panels 16 are deeper to accommodate the greater height of the second plurality of male interlocking members 66 in the lower portion 44 of the end panel 16. FIG. 16 shows the sectional view of the first plurality of interlocking members 64 of the upper portion 42 of the end panel 14 engaged with the interstices 82 in the first plurality of female interlocking members 80 of the upper portion 58 of the side panel 16. It will, therefore, be noticed that the interstices 82 of FIG. 16 are not as deep as those of FIG. 17 because they need only accommodate the lesser height of the first plurality of interlocking members 64.

Though the interlocking of the side and end panels 16 and 14 has been described such that the first and second pluralities of male interlocking members 64 and 66 are located on the end panel 14, and the first and second pluralities of female interlocking members 80 and 83 are located on the side panel 16, the reverse could also be true. Likewise, the male interlocking members 64 and 66 and female interlocking members 80 and 83 could be located on either or both of the first and second side edges 38 and 40 of the end panels 14 and first and second side edges 54 and 56 of the side panels 16.

While the specific embodiments have been illustrated and described, numerous modifications come to mind without significantly departing from the spirit of the invention and the scope of protection is only limited by the scope of the accompanying Claims.

I claim:

1. A collapsible bin including:

a base having an upper surface, a pair of opposing ends, and a pair of opposing sides;

a pair of opposing side panels, each side panel attachable to a respective base side, each side panel including an inner face, an outer face, and first and second side edges, the first and second side edges having an upper portion and a lower portion;

a pair of opposing end panels, each end panel attachable to a respective base end, each end panel including an inner face, an outer face, and first and second side edges, the first and second side edges having an upper portion and a lower portion;

at least one of the end panels including a first plurality of male interlocking members extending outward a first distance along the upper portion of its first side edge, and a second plurality of male interlocking members extending outward a second distance greater than the first distance along the lower portion of its first side edge; and at least one of the side panels including a plurality of female interlocking members along its first side edge for receiving the first and second pluralities of male interlocking members extending along the first side edge of the at least one end panel.

2. The bin of claim 1 wherein the first and second pluralities of male interlocking members each include an outer wall and a plurality of inwardly extending ribs from the outer wall generally perpendicular to the end panel outer face, the outer walls of the second plurality of male interlocking members being of a greater height than the outer walls of the first plurality of male interlocking members, and the inwardly extending ribs of the second plurality of male interlocking members having a raised portion nearest the outer wall forming fingers.

3. The bin of claim 2 wherein the fingers are integral with the outer walls.

4. The bin of claim 1 wherein the second plurality of male interlocking members in the at least one end panel and the female interlocking members of the at least one side panel engage as the side and end panels are moved to the assembled position as to create a zippering effect to facilitate alignment of the male and female interlocking members.

5. The bin of claim 1 wherein at least one of the pair of opposing end panels and pair of opposing side panels are hingedly attachable to the base.

6. The bin of claim 1 further including a third plurality of male interlocking members extending outward a third distance along the upper portion of the end panel first side edge, the third distance being less than the second distance.

7. A collapsible bin including:

a base having an upper surface, a pair of opposing ends, and a pair of opposing sides;

a pair of opposing side panels, each side panel attachable to a respective base side, each side panel including an upper portion and a lower portion, an inner face, an outer face, and first and second side edges;

a pair of opposing end panels, each end panel attachable to a respective base end, each end panel including an upper portion and a lower portion, an inner face, an outer face, and first and second side edges;

the end panels and side panels capable of movement between an assembled position generally perpendicular to the base and a folded position over the upper surface of the base;

at least one of the end panels including a first plurality of interlocking members along its first side edge;

at least one of the side panels including a second plurality of interlocking members along its first side edge for engaging the first plurality of interlocking members; and the interlocking members in the lower portions of the side and end panels engaging as the side and end panels are moved to the assembled position as to create a zippering effect to facilitate alignment of the interlocking members.

8. The bin of claim 7 wherein at least one of the pair of opposing end panels and pair of opposing side panels are hingedly attachable to the base.

9. The bin of claim 7 wherein the first plurality of interlocking members are male interlocking members, each including an outer wall and a plurality of inwardly extending ribs from the outer wall generally perpendicular to the end panel outer face, and further including a third plurality of male interlocking members located in the lower portion of the end panels, the outer walls of the second plurality of male interlocking members being of a greater height than the outer walls of the first plurality of male interlocking members, and the inwardly extending ribs of the second plurality of male interlocking members having a raised portion nearest the outer wall forming fingers.

10. The bin of claim 9 wherein the fingers are integral with the outer walls.

11. The bin of claim 7 wherein the first plurality of male interlocking members includes a lowermost member and an uppermost member, each member extending outward a distance from the first side edge, the distances generally decreasing in a direction from the lowermost member to the uppermost member.

12. The collapsible bin of claim 11 wherein the decrease in distance between successive adjoining male interlocking members is parabolic.

13. The collapsible bin of claim 11 wherein the decrease in distance between successive adjoining male interlocking members is a constant.

14. A collapsible bin including:

a base having an upper surface, a pair of opposing ends, and a pair of opposing sides;

a pair of opposing side panels, each side panel attachable to a respective base side, each side panel including an inner face, an outer face, and first and second side edges, the first and second side edges having an upper portion and a lower portion;

a pair of opposing end panels, each end panel attachable to a respective base end, each end panel including an inner face, an outer face, and first and second side edges, the first and second side edges having an upper portion and a lower portion;

at least one of the end or side panels including a first plurality of male interlocking members extending along its first side edge, the first plurality having a lowermost member and an uppermost member, each member extending outward a distance from the first side edge, the distances generally decreasing in a direction from the lowermost member to the uppermost member; and at least one of the other of the end or side panels including a second plurality of female interlocking members along its first side edge for receiving the first plurality of male interlocking members extending along the first side edge of the at least one end or side panel.

15. The bin of claim 14 wherein at least one of the pair of opposing end panels and pair of opposing side panels are hingedly attachable to the base.

16. The bin of claim 14 wherein the first plurality of male interlocking members include an outer wall and a plurality of inwardly extending ribs from the outer wall generally perpendicular to the end panel outer face, and the inwardly extending ribs having a raised portion nearest the outer wall forming fingers.

17. The bin of claim 14 wherein the first plurality of male interlocking members in the at least one end panel and the female interlocking members of the at least one side panel engage as the side and end panels are moved to the assembled position as to create a zippering effect to facilitate alignment of the male and female interlocking members.

18. The collapsible bin of claim 14 wherein the decrease in distance between successive adjoining male interlocking members is parabolic.

19. The collapsible bin of claim 14 wherein the decrease in distance between successive adjoining male interlocking members is a constant.

* * * * *